US005624356A

United States Patent [19]

Roberts

[11] Patent Number: 5,624,356

[45] Date of Patent: Apr. 29, 1997

[54] FOOT PEDAL FOR EXERCISE EQUIPMENT

[76] Inventor: Jimmie L. Roberts, P.O. Box 694, Poway, Calif. 92074

[21] Appl. No.: 637,835

[22] Filed: Apr. 25, 1996

[51] Int. Cl.[6] ..... A63B 22/06; F16H 7/22

[52] U.S. Cl. ..... 482/57; 482/71; 74/594.4

[58] Field of Search ..... 482/51, 52, 53, 482/57, 58–65; 74/594.6, 562, 564, 594.4, 594.1, 594.2, 594.7

[56] References Cited

U.S. PATENT DOCUMENTS

| | | | |
|---|---|---|---|
| 2,641,249 | 6/1953 | Brockman | 482/57 |
| 4,376,532 | 3/1983 | Hunstad | 482/71 |
| 4,587,960 | 5/1986 | Schotten | 482/57 |
| 4,786,050 | 11/1988 | Geschwender | 482/57 |
| 4,915,375 | 4/1990 | Ginsburg | 482/57 |
| 5,411,454 | 5/1995 | Chang | 482/53 |

*Primary Examiner*—Stephen R. Crow
*Attorney, Agent, or Firm*—Fitch, Even, Tabin & Flannery

[57] ABSTRACT

A padded foot pedal assembly for exercise equipment is disclosed. The foot pedal assembly includes a platform, a side plate attached to one side of the platform, and various attachment guides for engaging the foot pedal assembly with a crank handle or other extension member of the exercise equipment. The disclosed embodiment of the side plate is attached to one side of the platform and has a flat surface disposed adjacent to and in a generally perpendicular orientation with the upper surface of the platform. The padded foot pedal assembly also includes a polyurethane foam pad removably shrouding the upper surface of the platform and a retaining shoulder extending upward from the upper surface of the platform opposite from the side plate such that the removable pad is laterally retained by the side plate and the retaining shoulder. The disclosed embodiment of the polyurethane foam pad includes a treaded upper surface of a prescribed design and an engaging mechanism for removably engaging the pad with the platform whereby the pad is securely held in a stationary position relative to the pedal platform during use of the exercise equipment and can be easily removed from the pedal platform when not in use.

15 Claims, 4 Drawing Sheets

FOOT PEDAL FOR EXERCISE EQUIPMENT

BACKGROUND OF THE INVENTION

The present invention relates foot pedals for exercise equipment, and more particularly to an improved foot pedal with an impact absorbing exterior pad.

The use of exercise equipment such as stair stepping machines, exercise cycles, and the like necessarily involve a certain degree of impact. A common technique for reducing the impact encountered during use of such exercise equipment is the use of additional padding either on the individual's feet or on the exercise equipment.

Incorporating impact absorbing pads on the exercise equipment has typically not been the preferred option for reducing impact because the amount of padding or cushion needed or desired varies for each individual. For example, an individual who weighs less than 120 pounds may not need the same cushion to absorb the impact forces encountered when using a stair stepping machine as a 250 pound individual using the same equipment. In addition, too much cushion or padding on various exercise equipment often presents a situation that is not comfortable and not desirable for the individual.

Another problem associated with impact absorbing pads that are placed on directly on the exercise equipment, and particularly with pads placed on foot pedals of various exercise equipment, is that the pads tend to slip off or become disengaged during use of the equipment. In addition, impact absorbing pads are often uniquely designed items specially adapted for a particular make and model of exercise equipment. In other words, most impact absorbing pads suitable for placement on the exercise equipment are not per se interchangeable and cannot be used on other forms or models of exercise equipment.

Thus there is a need for a universal or generic foot pedal that can be used with many types of exercise equipment and that is specifically designed to receive and retain an impact absorbing pad. Conjunctively, there is also a need for a removable impact absorbing pad for use with the universal foot pedal and various other types of pedals for exercise equipment. The impact absorbing pad should be capable of being easily removed from and re-installed on the exercise equipment such that different individuals can use the same exercise equipment by merely changing the impact absorbing pad.

The present invention advantageously addresses the above and other needs.

SUMMARY OF THE INVENTION

The present invention advantageously addresses the needs above as well as other needs by providing an improved foot pedal assembly for exercise equipment. The improved foot pedal assembly includes a platform, a side plate attached to one side of the platform, an oppositely facing retaining shoulder extending from the upper surface of the platform, and various attachment channels for engaging the foot pedal assembly with a crank handle or other extension member of the exercise equipment. The disclosed embodiment of the improved foot pedal assembly shows the side plate being attached to one side of the platform with a flat surface disposed adjacent to and in a generally perpendicular orientation with the upper surface of the platform. The oppositely facing retaining shoulder is placed on the upper surface of the platform and spaced a prescribed distance from the flat surface of the side plate. The disclosed configuration of the improved pedal assembly is adapted to receive and retain a removable pad suitable for reducing impact forces encountered during the use of the exercise equipment.

The present invention may also be characterized as a generic foot pedal assembly for exercise equipment that includes a platform, a side plate, and a resilient pad substantially shrouding the upper surface of the platform. The generic foot pedal assembly further includes a plurality of attachment channels for engaging the padded foot pedal assembly with multiple makes and/or models of exercise equipment. Also included is an engaging mechanism for removably attaching or engaging the resilient pad with the platform such that the resilient pad is securely retained in a stationary position relative to the platform during use of the exercise equipment and wherein the resilient pad is easily removed and/or replaced when the exercise equipment is not in use.

The resilient pad is preferably a flexible polyurethane foam pad of a prescribed density and thickness which is suitable for reducing impact forces encountered during the use of said exercise equipment. The disclosed embodiment of the resilient pad also includes a layer of elastomeric material forming a treaded upper surface of a prescribed design.

Accordingly, it is an object of the present invention to provide an improved foot pedal that is suited for receiving and retaining a removable impact absorbing pad.

Another object of the invention is to provide an improved foot pedal that can be readily incorporated into many different makes and models of exercise equipment.

A feature of the present invention is the removable pad for a foot pedal. The preferred embodiment of the removable pad is both simple in construction and relatively inexpensive to fabricate. Another feature of the presently disclosed removable pad is the inclusion of surface tread of an aesthetically pleasing and functional design for improving traction between an individual's foot and the foot pedal.

Yet another feature of the invention is to make the pad both flexible and resilient, the resiliency of which can be tailored for specific individuals and/or levels of impact from particular items of exercise equipment.

An important advantage realized in the presently disclosed invention is that the foot pedal assembly is configured so as to laterally retain the pad thereby preventing its disengagement from the pedal during use of the exercise equipment.

Another advantage of the present invention is the simply technique for removing and re-installing the removable pad on the foot pedal. The removable pad can be easily removed and/or replaced as often as is necessary or as desired.

The above and other aspects, features and advantages of the present invention will be more apparent from the following more detailed description of the preferred embodiments, taken in conjunction with the accompanying drawings, which illustrate, by way of example, the principles of the present invention.

BRIEF DESCRIPTION OF THE DRAWINGS

In the following detailed description, reference will be made to the attached drawings in which.

Corresponding reference characters indicate corresponding components throughout the several views of the drawings.

DETAILED DESCRIPTION OF THE PREFERRED EMBODIMENTS

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
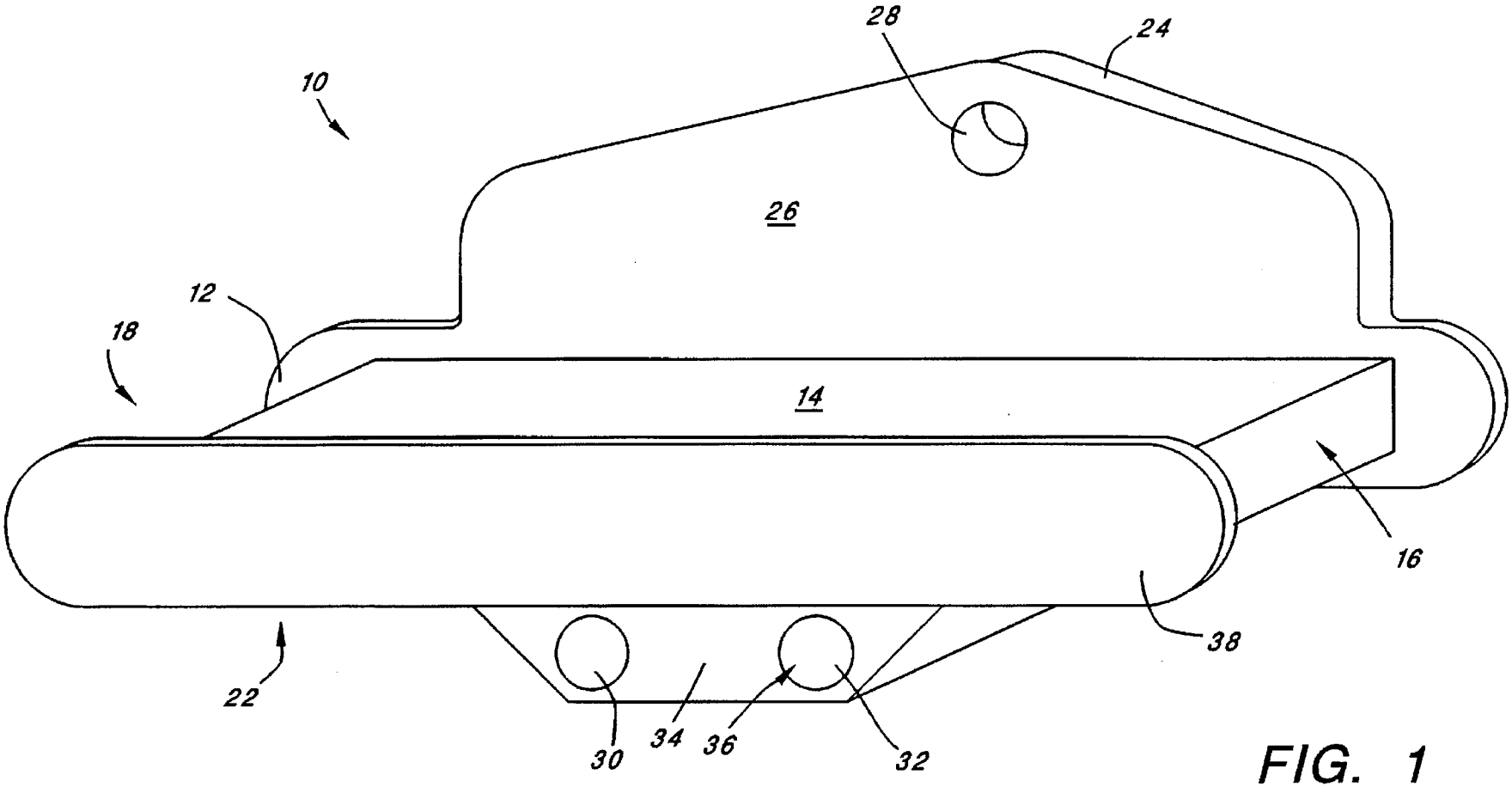
FIG. 1 is an illustration of the improved foot pedal assembly in accordance with the present invention.
Figure 2:
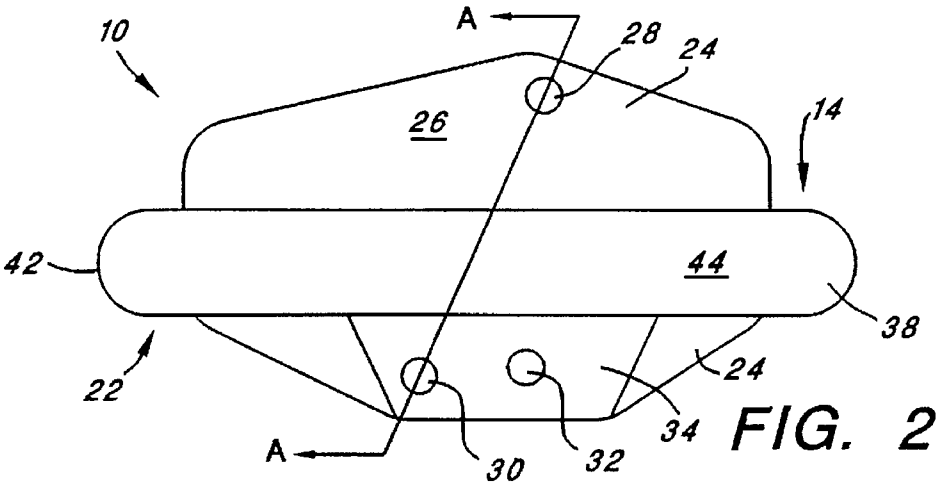
FIG. 2 is a side view of the improved foot pedal assembly of FIG. 1.
Figure 3:
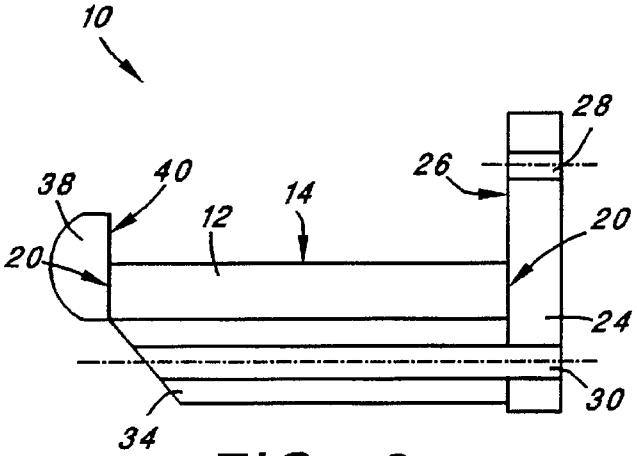
FIG. 3 is a cross sectional view of the foot pedal assembly taken along line A—A of FIG. 2.

Referring now to the drawings, and particularly to FIGS. 1 through 3, there are shown several different views of the improved foot pedal assembly 10 suitable for use on exercise equipment such as a stair stepping machine. As seen therein the foot pedal assembly 10 includes a generally rectangular shaped rigid platform 12 of a prescribed thickness and width. The rigid platform 12 includes an upper surface 14, a forward surface 16, an aft surface 18, a pair of side surfaces 20, and a lower surface 22. The upper surface 14 of the foot pedal assembly 10 is sufficiently wide to accommodate an individual's foot and is preferably a non-smooth surface to maintain traction between an individual's foot and the pedal assembly 10 during use of the exercise equipment.

The foot pedal assembly 10 also includes a side plate 24 attached to a side of the rigid platform 12. The side plate 24 is a structurally rigid plate having a flat surface 26 parallel to the side surfaces 20 of the rigid platform 12 and in orthogonal contact with the upper surface 14 of the platform 12. In other words, the side plate 24 is adjacent to and in a generally perpendicular orientation with the upper surface 14 of the platform 12. The side plate 24 in the illustrated embodiment also includes an upper bore 28 adapted to receive a screw or bolt to facilitate connection with the exercise equipment as well as two lower bores 30, 32. The general shape of the side plate 24 as well as the location of the upper bore 28 and lower bores 30, 32 are selected such that the improved foot pedal assembly 10 is can be used on many existing makes and models of exercise equipment.

The illustrated foot pedal assembly 10 also includes a lower base portion 34 attached to the lower surface 22 of the rigid platform 12 and further extending laterally from side plate 24. The lower base portion 34 includes one or more laterally extending channels 36 aligned with the lower bores 30, 32 of the side plate 24. The laterally extending channels 36 are prealigned with and adapted for receiving and engaging various extension members, such as the crank handle on selected configurations of exercise equipment. By having the multiple channels 36, the presently illustrated foot pedal assembly 10 is a generic type foot pedal assembly that is inter-changeable with existing foot pedals on at least two different types of stair stepping machines e.g. STAIRMASTER™ and TETRIX™. Like the platform 12, the lower base portion 34 of the foot pedal assembly 10 is of rigid construction. Preferably, the platform 12, lower base portion 34 and side plate 24 are cast aluminum structures. This rigid construction ensures that the foot pedal assembly 10 efficiently transfers forces to the exercise equipment as intended, while minimizing reliability concerns of the foot pedal assembly.

Lastly, the foot pedal assembly 10 illustrated in FIGS. 1 through 3 includes a generally oblong shaped retaining shoulder 38 attached to the side of the platform 12 opposite the side plate 24. Preferably, the retaining shoulder 38 has a pair of ends 42 which extends beyond the forward and aft facing surfaces 16,18 of the platform 12 and is spaced apart a select distance from the side plate 24 along the width, W, of the platform 12. As seen in FIGS. 1 and 3, the retaining shoulder 38 has a generally curved outer facing surface 44 and a flat interior facing surface 40 spaced apart from and oppositely facing the flat surface 26 of the side plate 24. The interior facing surface 40 of the retaining shoulder 38 together with the flat surface 26 of the side plate 24 collectively function to laterally retain objects placed on the upper surface 14 of the platform 12. For example, the interior facing surface 40 of retaining shoulder 38 together with the flat surface 26 of the side plate 24 can be used to laterally retain the foot of an individual using the exercise equipment. Advantageously, however, the interior facing surface 40 of retaining shoulder 38 and the flat surface 26 of the side plate 24 are specifically adapted to laterally retain a removable impact absorbing pad 50, as more fully described below.

Figure 6:
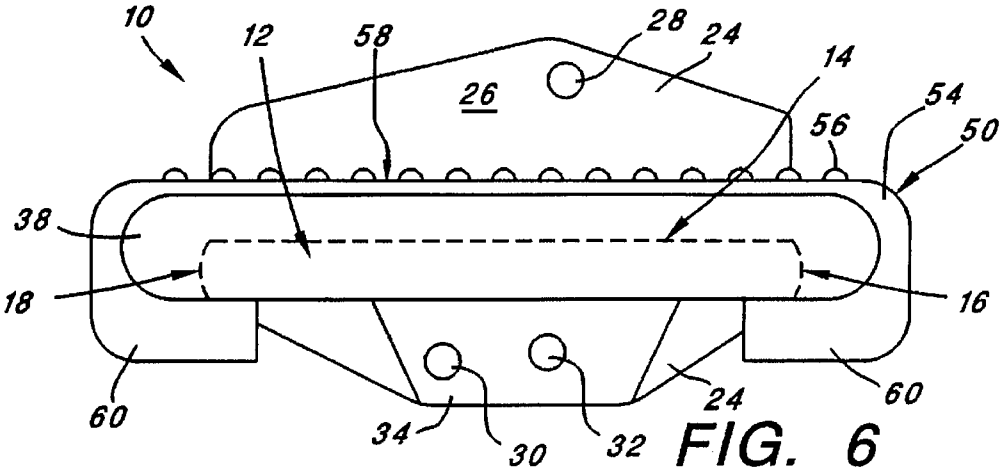
FIG. 6 is a side plan view of the improved foot pedal assembly of FIG. 5.
Figure 4:
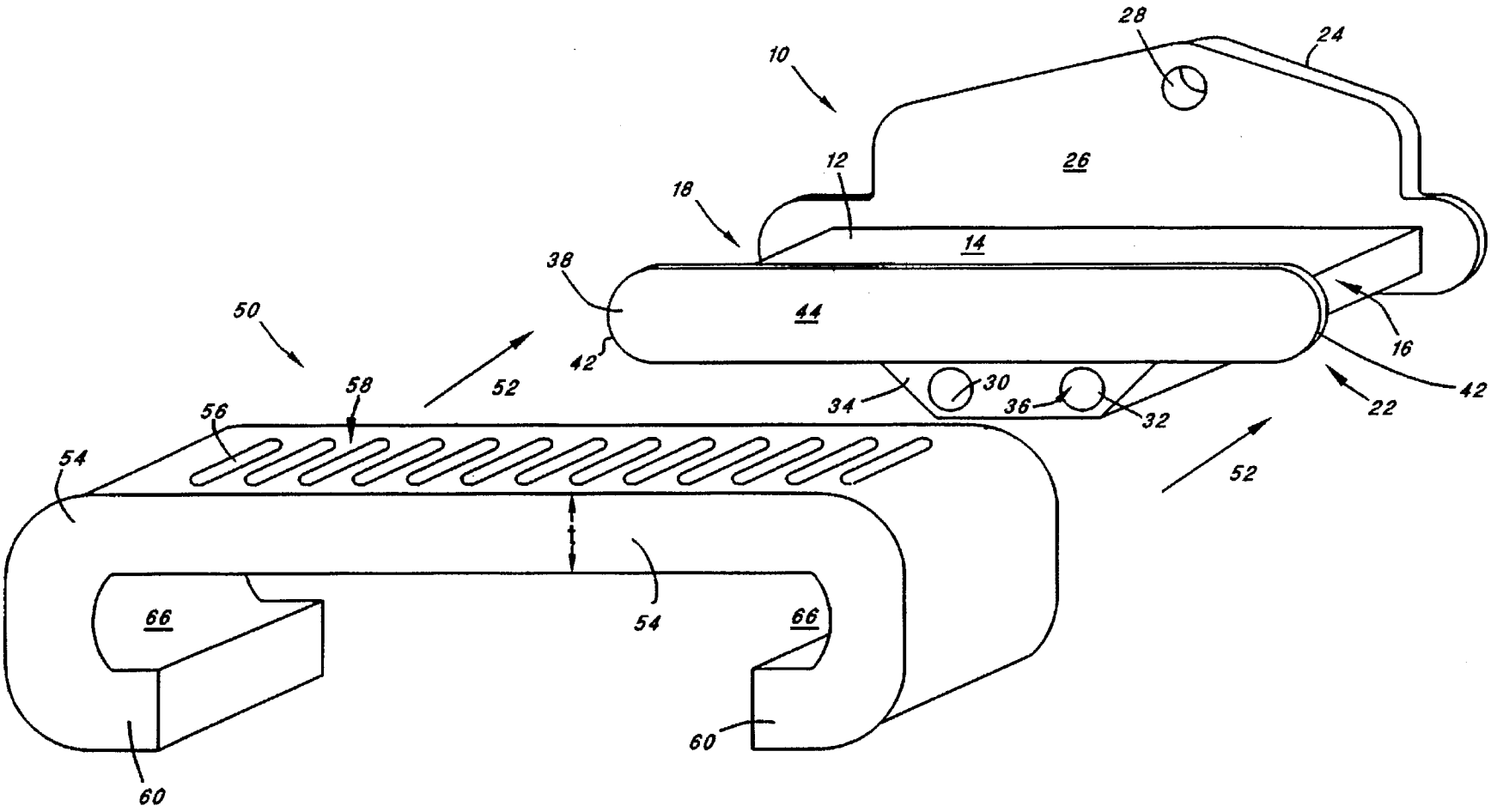
FIG. 4 is a perspective view of the foot pedal assembly and removable pad in adjoining positions.
Figure 5:
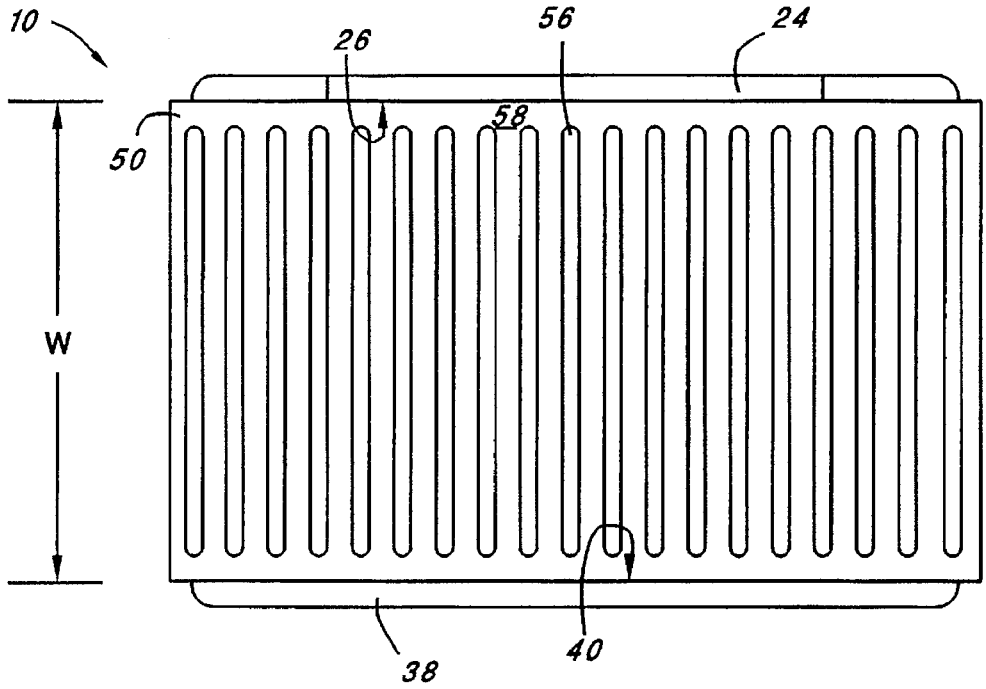
FIG. 5 is a top plan view of the improved foot pedal assembly of FIG. 4 shown with the removable pad attached thereto.

Referring now to FIGS. 4 through 6, the illustrated foot pedal assembly 10 is shown with a removable impact absorbing pad 50. As with the previously disclosed embodiment, the foot pedal assembly 10 includes a generally rectangular shaped rigid platform 12, having an upper surface 14, forward surface 14, aft surface 18, side surfaces 20, and lower surface 22. The foot pedal assembly 10 also includes the side plate 24, the retaining shoulder 38, and the pedal assembly engagement means. Advantageously, the illustrated embodiment includes also a resilient pad 50 that is dimensioned to fit over the platform 12 of the foot pedal assembly 10 as indicated by arrow 52 so that the pad 50 substantially shrouds or covers the upper surface 14 of the platform 12 between the side plate 24 and the retaining shoulder 38. Fitting the resilient pad 50 over the retaining shoulder 38 and onto the upper surface 14 platform 12 is accomplished by bending or otherwise deforming the pad 50 such that it stretches over the retaining shoulder 38 and around the ends 44 of the retaining shoulder 38. Once over the retaining shoulder 38, the resilient pad 50 subsequently returns to its original shape and shrouds the upper surface 14 of the platform 12.

As illustrated in FIGS. 4 through 6, the removable pad 50 is a unitary structure that includes a resilient base portion 54 of flexible polyurethane foam, an elastomeric tread 56 attached to the top surface 58 of the resilient base portion 54. The base portion 54 of the pad 50 is a C-shaped structure that generally conforms to the collective shape of the forward surface 14, upper surface 14 and aft surface 18 of the platform 12. The illustrated embodiment of the pad 50 also includes a pair of flexible end portions or members 60 extending from the respective ends of the base portion 54 and encompasses part of the lower surface 22 of the platform 12 to define an engagement cavity 66 into which the platform 12 snugly fits. These flexible end members 60 function to hold the pad 50 in engagement with the platform 12 and prevent movement of the pad 50 relative to the platform 12 in the vertical direction as well as the forward-aft direction when the exercise equipment is being used.

Because the removable pad 50 is constructed mainly of a resilient and flexible polyurethane foam, it is easily placed on and removed from the platform 12. Engagement between the flexible pad 50 and the platform 12 is readily accomplished by placing the pad 50 over the platform 12 in the lateral direction as indicated by the arrow 52 in FIG. 4. The polyurethane foam pad 50 is bent or otherwise deformed in order to pass over the retaining shoulder 38. The foam pad 50 then reverts to it's original shape as the pad 50 clears the shoulder 38 and abuts the flat surface 26 of the side plate 24. Alternatively, the polyurethane foam pad 50 may be wrapped around the upper surface 14 of the platform 12 in the forward-aft direction. Specifically, one end of the polyurethane foam pad 50 is placed in an engaging relation with either the forward surface 16 or the aft surface 18 of the platform 12. The other end of the pad 50 is then deformed sufficiently to allow the pad 50 to be stretched around the opposite facing surface of the platform 12. When released, the flexible polyurethane foam pad 50 reverts back to its original C-shaped configuration substantially shrouding the upper surface 14, forward surface 14 and aft surface 18 of the platform 12. Disengagement of the pad 50 from the platform 12 is accomplished in a similar manner. By either taking the pad 50 off the platform 12 in the lateral direction over the retaining shoulder 38 or unwrapping the pad 50 from one end of the platform 12 and subsequently removing the pad 50 from the platform 12.

The width W of the removable pad is such that, when engaged with the platform 12, the pad 50 forms a tight interference fit between the flat surface 26 of the side plate 24 and the interior facing surface 40 of the retaining shoulder 38. As such, the removable pad 50 is preventing from movement in the lateral direction during use of the equipment. Alternatively, the width W of the pad may be larger so long as the retaining shoulder 38 engages the pad 50 to prevent lateral movement during use. The thickness, t, of the pad, on the other hand, is selected to provide an adequate cushion against impact forces encountered during the operational use of the exercise equipment. The presently disclosed embodiment of pad 50 contemplates a base portion thickness of about 0.5 inches to 0.75 inches and a tread thickness of about 0.1 inches. In the illustrated embodiment, the height of the interior surface 40 of the retaining shoulder 38, against which the side of the pad abuts, is about 0.4 inches which provides a relatively large surface area to retain the pad in place.

The preferred embodiment of the removable pad 50 is fabricated with a molding process which forms the removable pad 50 into the desired shape while concurrently bonding the elastomeric tread 56 to the top surface 58 of the polyurethane foam base portion 54. The base portion 54 is formed from a self-skinning flexible polyurethane foam of a prescribed density. During the molding process, a prescribed volume of the elastomeric material is poured into the selected mold first followed by a the polyurethane foam. By adjusting the density of the polyurethane foam, the pad 50 is made with different degrees of resiliency. The measure of resiliency allows the pad 50 to be tailored to specific applications. As indicated above, an individual who weighs less than 120 pounds may not need the same cushion to absorb the impact forces encountered when using the exercise equipment as a 250 pound individual. Accordingly, the preferred embodiment of the removable pad 50 contemplates at least three levels of resiliency e.g. soft, medium, and hard. The soft pad has a density about two to three percent less than the density of the medium pad. Likewise, the medium pad has a density about two to three percent less than the density of the hard pad. Clearly, numerous variations on the resiliency of the pad can be achieved merely by adjusting the density of the polyurethane foam.

As indicated above, the treaded surface 56 of the removable pad 50 is also formed during the molding process. The specific tread design of the pad 50 is selected by pouring an elastomeric material into the appropriate mold. It is important to maintain the elastomeric tread surface 56 as a relatively hard surface for all selected densities of the polyurethane foam. If the elastomeric tread surface 56 is made too soft, it tends to become rather sticky which presents an undesirable pedal assembly surface.

Figure 7:
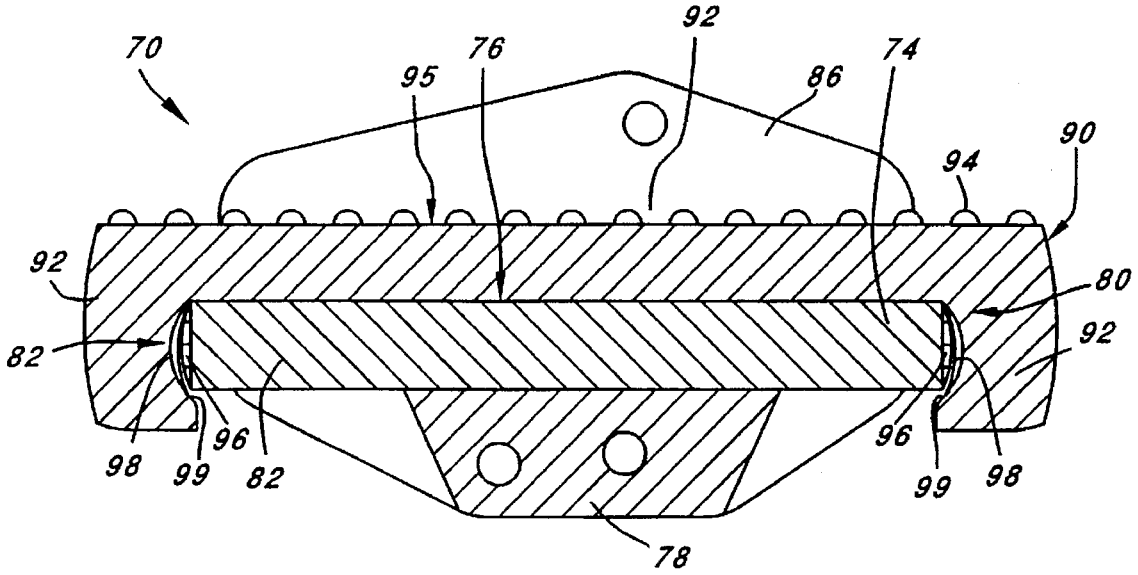
FIG. 7 is a side cross-sectional view of another embodiment of the improved foot pedal assembly depicting an alternate technique for removably engaging the pad with the pedal assembly platform.

Turning now to FIG. 7, there is shown a side plan view of another embodiment of the improved foot pedal assembly 70 depicting an alternate technique for removably engaging the pad with the pedal assembly platform 74. As with the previously disclosed embodiment, the foot pedal assembly 70 includes a rigid platform 74, having an upper surface 76, lower surface 78, forward surface 80, aft surface 82, and side surfaces. The foot pedal assembly 70 also includes the side plate 86, the retaining shoulder (not shown), the removable pad 90 and the pedal assembly engagement means. The removable pad 90 further includes the previously described flexible polyurethane foam base 92 and elastomeric tread 94 formed on the upper surface 95 of the pad 90. However, in lieu of the flexible end members to hold the pad in engagement with the platform, this alternative embodiment utilizes a hook and loop fastening mechanism, commonly identified by the trademark "VELCRO". A strip of the loop portion 96 of the hook and loop fastening mechanism is attached to the forward surface 80 and aft surface 82 of the rigid platform 74. Corresponding strips of the hook portion 98 are attached to the interior lower surfaces 99 of the base 92 at locations which align with the forward and aft surfaces 80, 82 of the platform 74.

The hook and loop fastening mechanism keeps the pad 90 in a stationary position relative to the rigid platform 74 in all three directions, e.g. lateral direction, vertical direction, and forward-aft direction, when the exercise equipment is being used. When desired, the pad 90 is easily removed from the platform 74 by pulling the hook and loop fastening mechanisms apart, as is well known in the art, and lifting the pad 90 from the upper surface 76 of the platform 74. Pads can be re-installed by placing and aligning a new or different pad over the upper surface of the platform and pressing the hook and loop fastening mechanisms together. In this manner various pads can be readily removed and replaced as often as is necessary or as desired.

Clearly, there are many different techniques and mechanisms for removably engaging the pad with the platform including techniques and mechanisms such as fastening straps, retaining clips, and other known engaging and retaining means.

Advantageously, the removable pad is adapted to be used on a variety of exercise equipment including various items of equipment that do not utilized a foot pedal. For example, the removable pad can be adapted for use with step platforms used in aerobic workouts as well as on stair stepping machines, exercise cycles, weight machines and other impact generating exercise equipment.

The present invention will be understood from the foregoing description, and it will be apparent that numerous modifications and variations could be made thereto without departing from the spirit and scope of the invention or sacrificing all of its material advantages, the forms hereinbefore described being merely exemplary embodiments thereof. To that end, it is not intended that the scope of the invention be limited to the specific embodiments illustrated and described. Rather, it is intended that the scope of this invention be determined by the appending claims and equivalents.

What is claimed is:

1. A foot pedal assembly for exercise equipment comprising:

a platform having an upper surface, side surfaces, and a lower surface;

a side plate attached to one of said side surfaces of said platform, said side plate having a flat surface disposed adjacent to and in a generally perpendicular orientation with said upper surface of said platform;

a removable pad substantially shrouding said upper surface of said platform and wherein said removable pad is laterally retained by said side plate and said retaining shoulder;

a retaining shoulder disposed on said upper surface of said platform opposite from said side plate and proximate to another of said side surfaces of said platform; and said means for engaging said foot pedal assembly with said exercise equipment;

wherein said pedal assembly is adapted for receiving and retaining said removable pad, said removable pad being adapted for reducing impact forces encountered during the operational use of said exercise equipment.

2. The foot pedal assembly of claim 1 wherein said removable pad further comprises:

a resilient base portion adapted to substantially shroud said upper surface of said platform;

a treaded surface formed on said resilient base portion; and a means for removably engaging said pad from said platform;

wherein said pad is securely retained in a stationary position relative to said platform during operational use of said pedal assembly and wherein said pad is selectively removed from said platform.

3. The foot pedal assembly of claim 2 wherein said resilient base portion is flexible polyurethane foam.

4. The foot pedal assembly of claim 3 wherein the density of said resilient base portion is varied to produce different degrees of resiliency.

5. The foot pedal assembly of claim 2 wherein said treaded surface is an elastomeric layer bonded to said base portion and further having an exposed tread of a prescribed design.

6. The foot pedal assembly of claim 2 wherein said means for removably engaging said removable pad from said platform is a pair of flexible members extending from said base of said removable pad to define an engagement cavity into which said platform snugly fits.

7. The foot pedal assembly of claim 1 wherein said means for engaging further comprises a lower base having a channel laterally disposed therein, said channel adapted for receiving a crank handle from said exercise equipment.

8. The foot pedal assembly of claim 1 wherein said means for engaging further comprises a lower base having one or more channels laterally disposed at preselected locations therein, said channels being prealigned with and adapted for receiving extension members from various configurations of exercise equipment such that said pedal assembly can be used on such various configurations of exercise equipment.

9. A foot pedal assembly for exercise equipment comprising:

a platform having an upper surface and side surfaces;

a side plate attached to one of said side surfaces of said platform, said side plate having a flat surface disposed adjacent to and in a generally perpendicular orientation with said upper surface of said platform;

a resilient pad substantially shrouding said upper surface of said platform;

a lower base attached to said platform having a plurality of channels laterally disposed at preselected locations therein, said channels being prealigned with and adapted for receiving extension members from various configurations of exercise equipment such that said pedal assembly can be used on such multiple configurations of exercise equipment; and a means for removably engaging said resilient pad from said platform wherein said pad is securely retained in a stationary position relative to said platform during operational use of said pedal assembly and wherein said resilient pad can selectively be removed and replaced when not in use.

10. The foot pedal assembly of claim 9 further comprising a retaining shoulder disposed opposite from said side plate and proximate to another of said side surfaces of said platform wherein said resilient pad is laterally retained by said side plate and said retaining shoulder.

11. The foot pedal assembly of claim 9 wherein said means for removably engaging said resilient pad from said platform is a pair of flexible members extending from a lower portion of said resilient pad to define an engagement cavity into which said platform snugly fits.

12. The foot pedal assembly of claim 9 wherein said resilient pad is a flexible polyurethane foam pad.

13. The foot pedal assembly of claim 12 wherein the density of said resilient pad is varied to produce different degrees of resiliency.

14. The foot pedal assembly of claim 12 wherein said resilient pad includes a treaded upper surface.

15. The foot pedal assembly of claim 14 wherein said treaded upper surface is an elastomeric layer bonded to said foam pad and further having an exposed tread of a prescribed design.

* * * * *